US007147087B2

(12) United States Patent
Tanaka

(10) Patent No.: US 7,147,087 B2
(45) Date of Patent: Dec. 12, 2006

(54) ELEVATOR WITH DUCT FOR TAIL CORD

(75) Inventor: Kazuhiro Tanaka, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 200 days.

(21) Appl. No.: 10/726,538

(22) Filed: Dec. 4, 2003

(65) Prior Publication Data

US 2004/0159502 A1 Aug. 19, 2004

(30) Foreign Application Priority Data

Dec. 5, 2002 (JP) ..... P2002-354194

(51) Int. Cl.
*B66B 7/00* (2006.01)
*B66B 1/00* (2006.01)

(52) U.S. Cl. ..... 187/413; 187/277; 187/414

(58) Field of Classification Search ..... 187/264, 187/266, 413, 414
See application file for complete search history.

(56) References Cited

U.S. PATENT DOCUMENTS 1,145,914 A * 7/1915 Magnuson ..... 187/413
1,810,960 A * 6/1931 Hall ..... 187/413
1,822,153 A * 9/1931 Kinnard ..... 187/413
1,864,093 A * 6/1932 Prince ..... 187/413
1,952,766 A * 3/1934 Mazer ..... 428/147
2,017,372 A * 10/1935 Morrison ..... 187/413
2,878,048 A * 3/1959 Peterson ..... 277/355
3,344,888 A * 10/1967 Connelly et al. ..... 187/413
3,430,733 A * 3/1969 Smith ..... 187/413
4,058,186 A * 11/1977 Mullis ..... 187/413
4,269,380 A * 5/1981 Shima et al. ..... 248/74.1
4,457,515 A * 7/1984 Eidschun ..... 277/301
5,080,199 A * 1/1992 McCallum, III ..... 187/413
6,223,860 B1 * 5/2001 Namba et al. ..... 187/277
6,619,435 B1 * 9/2003 Watzke et al. ..... 187/373
6,786,306 B1 * 9/2004 Tiner ..... 187/413

* cited by examiner

*Primary Examiner*—Kathy Matecki
*Assistant Examiner*—Eric E. Pico
(74) *Attorney, Agent, or Firm*—Oblon, Spivak, McClelland, Maier & Neustadt, P.C.

(57) ABSTRACT

An elevator is provided to prevent a tail cord from being projected out of a tail-cord duct under the influence of air current flowing in the tail-cord duct. The tail-cord duct is formed along an elevating space in which a passenger car moves up and down. The tail-cord duct is provided, along the elevating space, with an opening that opens it. An arm part fixed to the passenger car is introduced into the tail-cord duct. In the tail-cord duct, a tail cord is suspended from the arm part. In plan view of the tail-cord duct, a portion of the arm part for suspending the tail cord is shifted from the opening in a duct-width direction of the duct.

21 Claims, 9 Drawing Sheets

ELEVATOR WITH DUCT FOR TAIL CORD

CROSS-REFERENCE TO RELATED APPLICATION

This application is based upon and claims the benefit of priority from the prior Japanese Patent Application No. 2002-354194, filed on Dec. 5, 2002; the entire contents of which are incorporated herein by reference.

BACKGROUND OF THE INVENTION

1. Field of the Invention

The present invention relates to an elevator, particularly, an elevator equipped with a duct for tail cord.

2. Description of the Related Art

FIGS. 1 and 2 show a conventional "outdoor" type elevator in part. This elevator 100 includes a passenger car 101 moving up and down in an elevating space surrounded by no elevating wall. In the vicinity of the elevating space, there is a tail-cord duct 103 that is formed to extend along the elevating space. The tail-cord duct 103 is surrounded, in its circumference, by a wall part 102. Further, the tail-cord duct 103 is provided with an opening 104 that opens to the elevating space.

An arm part 105 is fixed to the passenger car 101 so as to project into the tail-cord duct 103 through the opening 104. A tail cord 106 introduced from the passenger car 101 is suspended from the leading end of the arm part 105 into the tail-cord duct 103. The other side of the tail cord 106 suspended above is slung up in the tail-cord duct 103. Thus, the other end of the tail cord 106 is connected to an appropriate element, for example, a control panel (not shown) in a machine room (also not shown). In this way, the tail cord 106 is accommodated in the tail-cord duct 103 while being hung therein in a substantial U-shaped manner.

Additionally, a governor rope 107 for emergency stop is arranged at the opening 104 so as to be movable with the elevating movement of the passenger car 101.

In the above-mentioned structure of the elevator 100, when the passenger car 101 moves up and down, one side (free end) of the tail cord 106 moves up and down together with the passenger car 101. Corresponding to the vertical position of the passenger car 101 in the elevating space (not shown), the tail cord 106 changes its lowermost position while maintaining the electrical connection between the passenger car 101 and the control panel (not shown). Similarly, when the passenger car 101 moves up and down, the governor rope 107 also moves correspondingly. If the moving speed of the governor rope 107 exceeds a predetermined speed, then it is carried out to stop the moving of the governor rope 107 to make an emergency stop of the passenger car 101.

Meanwhile, it is noted that the above-mentioned elevating space of the "outdoor" type elevator is not surrounded by an elevating wall because of its open-air arrangement. Therefore, an ambient wind enters into the tail-cord duct 103 through the opening 104, so that an air current occurs in the duct 103 with various flowing directions. Under such a situation, if the air current flows out of the tail-cord duct 103 through the opening 104, the tail cord 103 may project out of the interior of the duct 103 through the opening 104 under the influence of the air current flowing in such a direction.

Such an undesirable phenomenon will be described below, in detail.

Namely, it is noted in the conventional "outdoor" type elevator 100 that the straight arm part 105 is inserted into the tail-cord duct 103 through the opening 104 and the tail cord 106 is suspended from the leading end of the arm part 105. Thus, as shown in FIG. 2, part of the tail cord 106, which extends from its one end from the U-shaped lowermost part, is arranged within an area corresponding to the opening 104, in other words, in a position allowing the tail cord 106 to be visible from the side of the elevating space through the opening 104. Due to such a relationship in position between the tail cord 106 and the opening 104, if a current is produced flowing from the opening 104 to the outside, it is feared that the tail cord 106 projects from the opening 104 as shown with chain double-dashed line of FIG. 1. Again noted it is undesirable that the tail cord 106 projects from the tail-cord duct 103, in view of avoiding operational troubles of the elevator 100.

Additionally, the governor rope 107 at the opening 104 oscillates under the influence of the air current flowing out through the opening 104, as shown with arrows of FIG. 1. When the governor rope 107 collides with the end face of the opening 104 due to the above oscillation, there arises a problem of causing abnormal noise.

SUMMARY OF THE INVENTION

It is therefore an object of the present invention to provide an elevator that can prevent a tail cord from projecting out of a tail-cord duct due to the influence of an ambient wind.

Further, it is another object to provide an elevator that can prevent an occurrence of abnormal noise due to the oscillation of a governor rope. According to the present invention as the first feature, the above objects of the present invention can be accomplished by an elevator, comprising: a passenger car having a tail cord extending therefrom; an elevating space defined so as to encompass the passenger car thereby allowing the passenger car to move up and down therein; a tail-cord duct adjoining the elevating space, the tail-cord duct having a tail-cord flexure space formed therein to extend along the elevating space in a vertical direction thereof, the tail-cord flexure space accommodating the tail cord therein so that the tail cord extends from its free end on the side of the passenger car up to a duct's side suspending position for suspending the tail cord in a U-shaped manner, the tail-cord duct having an opening formed to extend along and open to the elevating space in a vertical direction; and an arm part fixed to the passenger car so as to project therefrom toward the tail-cord duct, the arm part having its leading end positioned in the tail-cord duct, wherein, in plan view of the elevator, the leading end of the arm part is shifted from the opening of the tail-cord duct in a duct-width direction connecting one plan position of the duct's side suspending position with another plan position of the free end of the tail cord, and the free end of the tail cord is carried by the leading end of the arm part.

In the invention of the first feature, only part of the U-shaped lowermost portion of the tail cord is positioned in an area according with the opening, that is, within a range enabling the tail cord to be visible from the side of the elevating space through the opening. While, the most part of the tail cord is arranged in an area discording with the opening. Accordingly, the elevator of the first feature has a structure that makes it difficult for the tail cord to project from the tail-cord duct due to air current flowing out of the tail-cord duct through the opening. Thus, it is possible to prevent the tail cord from projecting from the interior of the tail-cord duct, thereby preventing both damage on the tail cord and occurrence of abnormal noise.

According to the second feature of the invention, there is also provided an elevator comprising: a passenger car; a transmission line for transmitting signals to move the passenger car up and down and a supporting member arranged so as to project from the passenger car, the supporting member allowing the transmission line to be suspended therefrom in the vicinity of a leading end of the supporting member, thereby supporting the transmission line, wherein the supporting member has its leading side arranged to extend into a designated space through an opening formed in a structure for supporting the passenger car, and in plan view, a position for suspending the transmission line is deviated from a first area interposed between inner walls on both sides of the opening and a second area obtained by extending the first area along the supporting member.

In the invention of the second feature, the most part of the transmission line, which is supported in the vicinity of the leading end of the supporting member, is arranged in an area discording with the opening. Accordingly, the elevator of the second feature has a structure that makes it difficult for the tail cord to project from the tail-cord duct due to air current flowing out of the tail-cord duct through the opening. From above, it is possible to prevent the tail cord from projecting from the interior of the tail-cord duct, thereby preventing both damage on the tail cord and occurrence of abnormal noise.

According to the second feature of the invention, there is further provided an elevator comprising: a passenger car; a transmission line for transmitting signals to move the passenger car up and down and a supporting member arranged so as to project from the passenger car, the supporting member allowing the transmission line to be suspended therefrom in the vicinity of a leading end of the supporting member, thereby supporting the transmission line, wherein the supporting member has its leading side arranged to extend into a designated space through an opening formed in a structure for supporting the passenger car, and in view from the passenger car, the leading end of the supporting member is positioned on the back side of a wall part forming the structure.

In the invention of the third feature as well, the most part of the transmission line, which is supported in the vicinity of the leading end of the supporting member, is arranged in an area discording with the opening. Accordingly, the elevator of the second feature has a structure that makes it difficult for the tail cord to project from the tail-cord duct due to air current flowing out of the tail-cord duct through the opening. From above, it is possible to prevent the tail cord from projecting from the interior of the tail-cord duct, thereby preventing both damage on the tail cord and occurrence of abnormal noise.

According to the fourth feature of the invention, there is still further provided an elevator comprising: a passenger car; a transmission line for transmitting signals to move the passenger car up and down and a supporting member arranged so as to project from the passenger car, the supporting member allowing the transmission line to be suspended therefrom in the vicinity of a leading end of the supporting member, thereby supporting the transmission line, wherein the supporting member has its leading side arranged to extend into a designated space through an opening formed in a structure for supporting the passenger car, the supporting member is arranged to extend obliquely in plan view, and the leading end of the supporting member is positioned on the backside of a wall part forming the opening of the structure in view from the passenger car toward the designate space.

In the invention of the fourth feature, since the supporting member is arranged so as to obliquely extend from the passenger into the designated space through the opening, the leading end of the supporting member is positioned on the backside of the wall part of the structure in view from the passenger car toward the designate space view. Therefore, it becomes difficult for the transmission line to be moved in its projecting direction due to air current flowing out of the designated space through the opening. Additionally, since the above-mentioned relationship in position between the wall part of the structure and the leading end of the supporting member is brought by only tilting an angle of the supporting member to the passenger car, it is possible to save the manufacturing cost of the elevator.

These and other objects and features of the present invention will become more fully apparent from the following description and appended claims taken in conjunction with the accompany drawing.

DESCRIPTION OF THE PREFERRED EMBODIMENT

Figure 1:
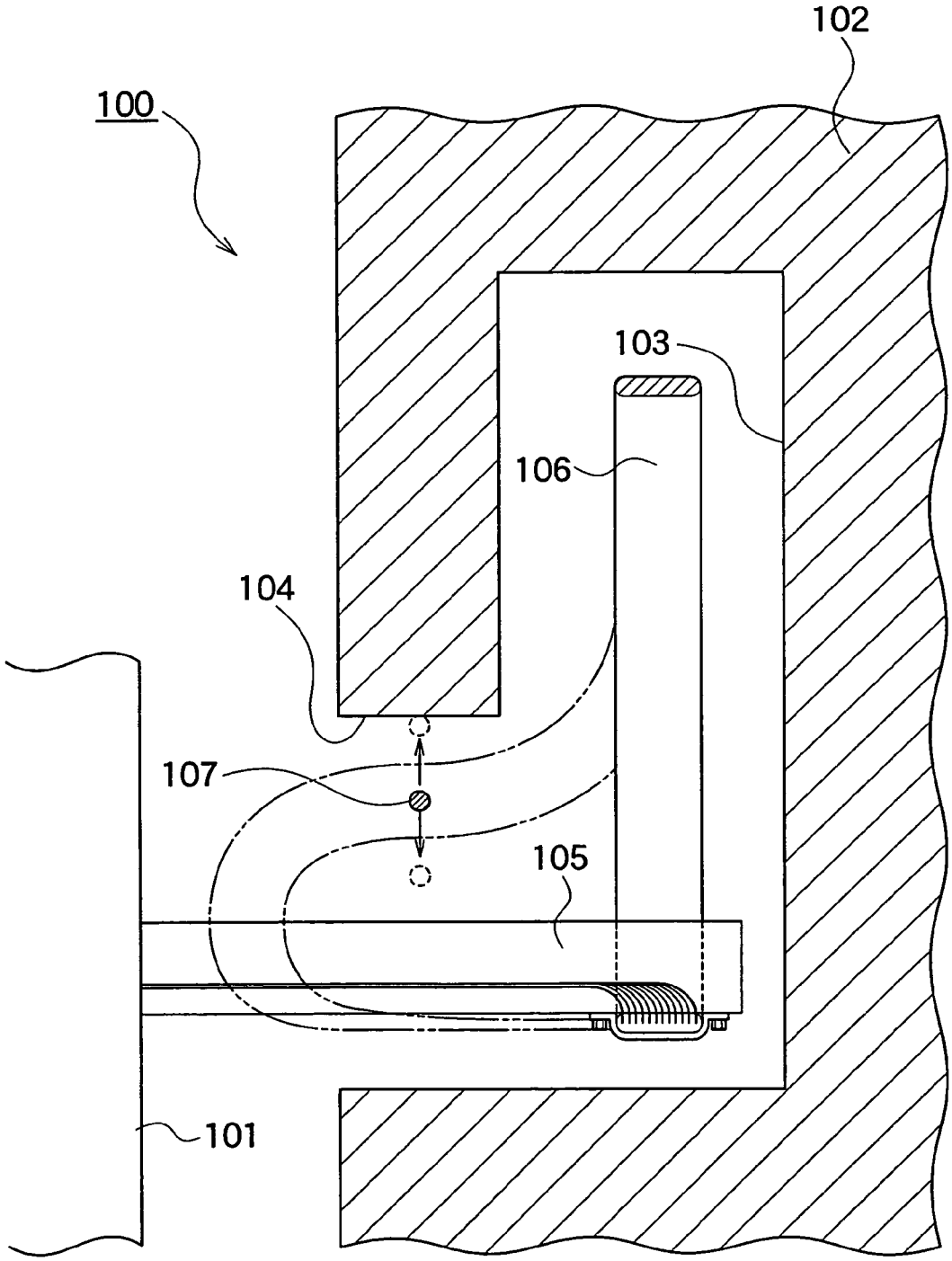
FIG. 1 is a sectional view of the substantial part of the conventional elevator.
Figure 2:
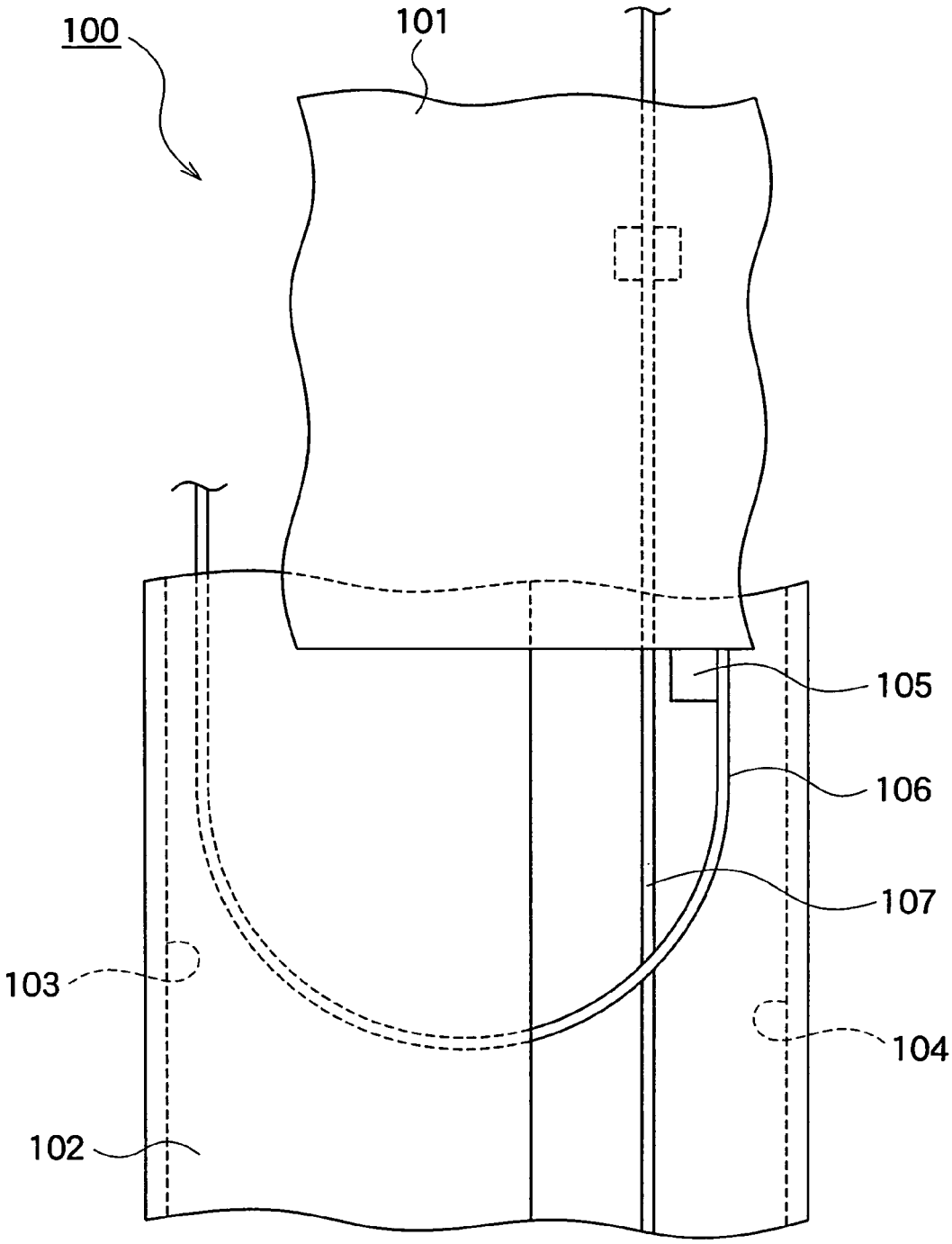
FIG. 2 is a front view of the conventional elevator.

Referring to the drawings, embodiments of the present invention will be described below.

1st. Embodiment

Figure 3:
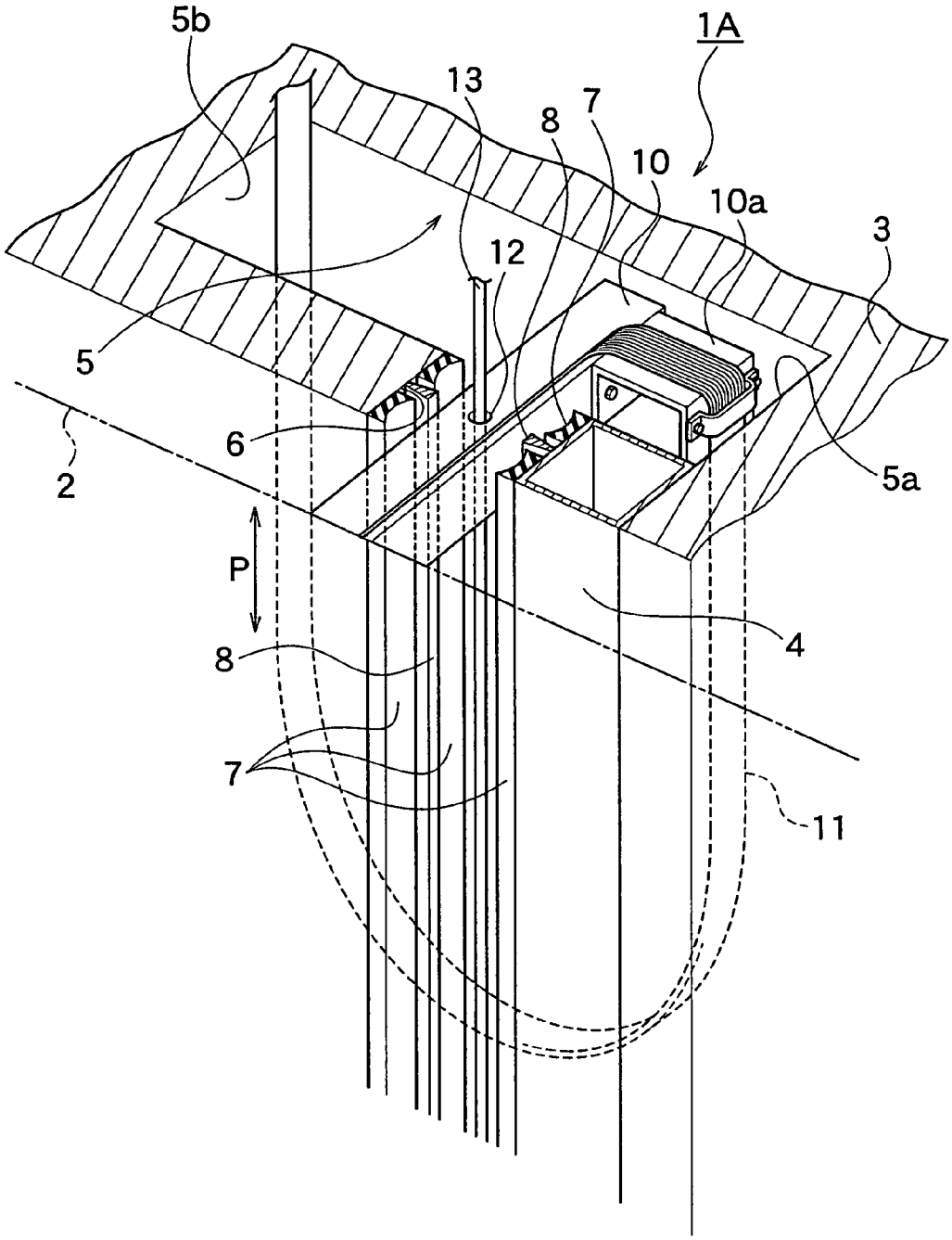
FIG. 3 is a perspective view of an elevator in accordance with the first embodiment of the present invention, showing a broken essential part of the elevator.
Figure 4:
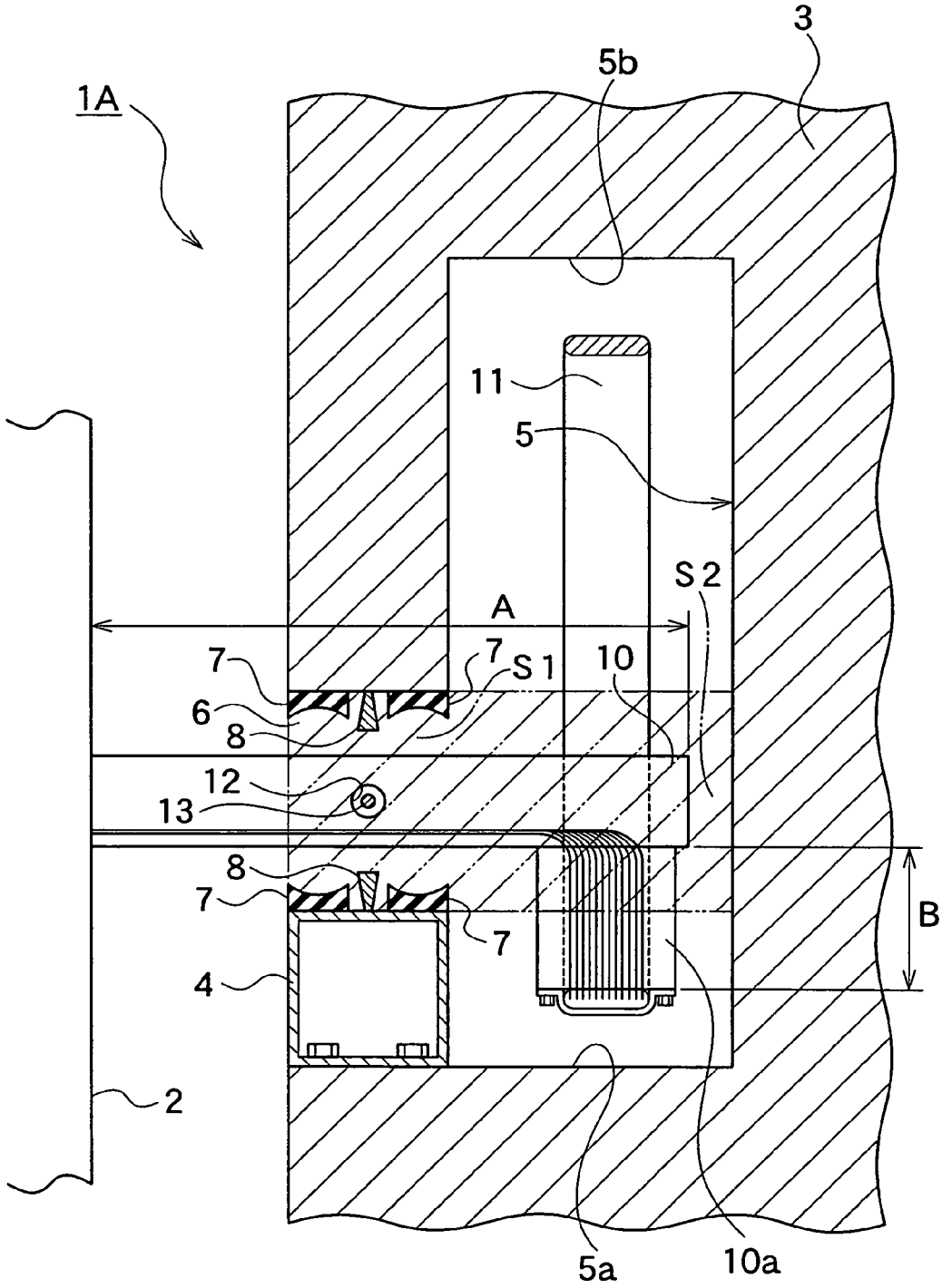
FIG. 4 is a sectional view of the essential part of the elevator in accordance with the first embodiment of the present invention.
Figure 5:
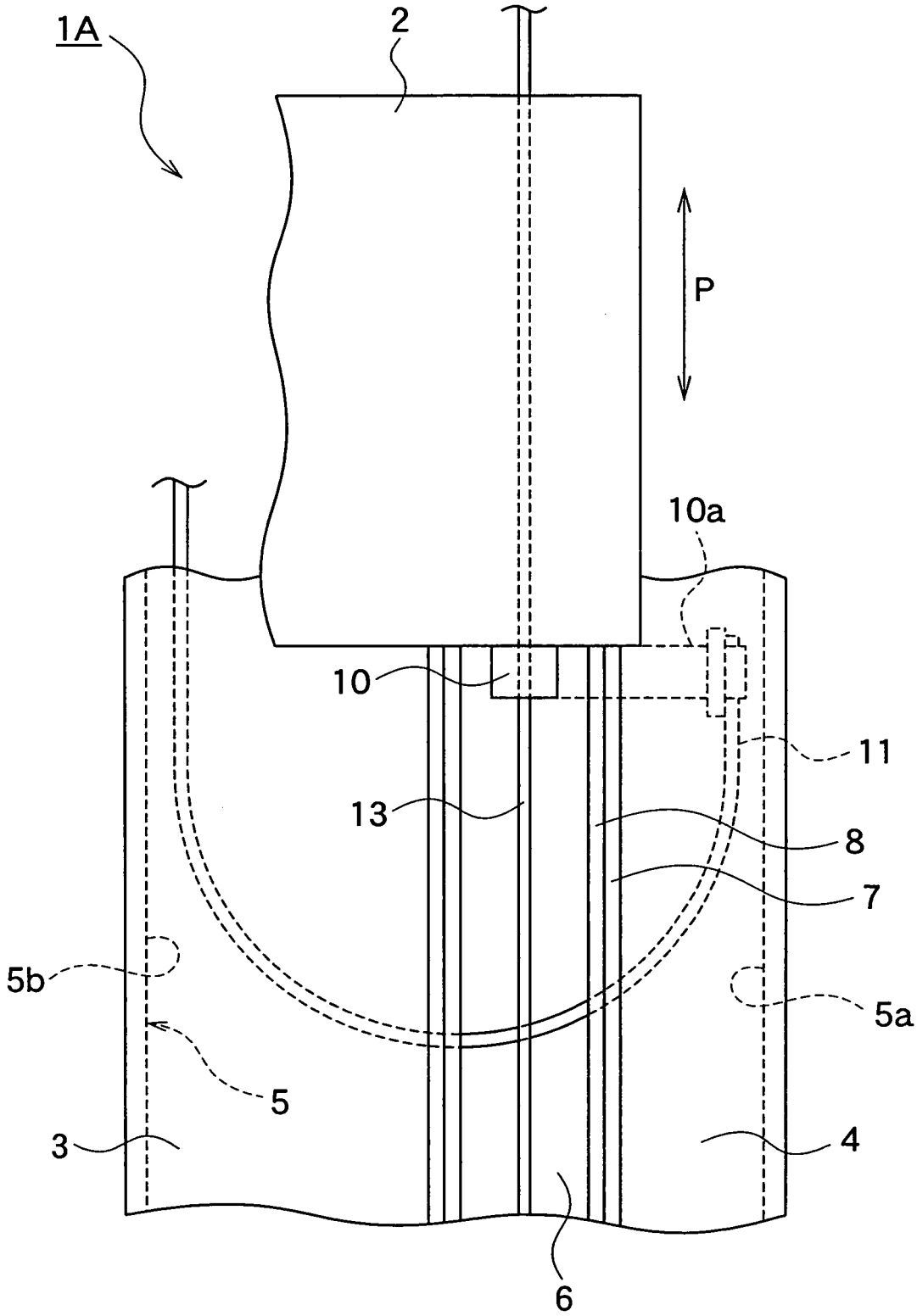
FIG. 5 is a front view of the essential part of the elevator in accordance with the first embodiment of the present invention.

FIGS. 3 to 5 show an elevator in accordance with the first embodiment of the present invention. In these figures, FIG. 3 is a perspective view of the elevator 1A of the first embodiment, showing its essential part in section. FIG. 4 is a sectional view of the essential part of the elevator 1A. FIG. 5 is a front view of the essential part of the elevator 1A.

As shown in FIGS. 3 to 5, a passenger car 2 of the elevator 1A is adapted so as to move up and down (move up-and-down direction) in an elevating space surrounded by no elevating wall. In the vicinity of the elevating space, there is defined, as a designated space (alias, tail-cord flexure space), a tail-cord duct 5 which is surrounded by a wall part 3 and a panel member 4 except part of the duct 5. The tail-cord duct 5 is arranged to extend along the elevating space for the passenger car 2 (i.e. an elevating direction P in the figure). Additionally, the tail-cord duct 5 has an opening 6 formed to open in the form of a slit along the elevating space (elevating direction P). Since the panel member 4 is fixed to one lateral side of an opening formed about the wall part 3, the above opening 6 is established to have a small width in comparison with that of the conventional opening. Further, it is noted that the opening 6 is shifted a little to the duct's center in a direction of the width of the tail-cord duct 5 due to the provision of the panel member 4.

Fixed on opposing end faces on both sides (in the width direction) of the opening 6 are rubber units that have absorber action respectively. These rubber units are arranged to extend along the elevating space (elevating direction P). Each of the rubber units includes two rubber members 7 at an interval in the depth direction of the tail-cord duct 5 and a brush 8 arranged in a clearance between the adjoining rubber members 7. The left and right brushes 8 are arranged to each project in a direction to reduce the width of the opening 6.

As a supporting member, an arm part 10 is fixed to the lower end of the passenger car 2. The arm part 10 is introduced into the tail-cord duct 5 through the opening 6. About the arm part 10, its portion entering the tail-cord duct 5 is bent toward one side of the duct 5, providing a clinching (or bending) part 10*a* that operates as an auxiliary supporting member. The clinching part 10*a* is arranged so that its leading end approaches an inner wall 5*a* of the tail-cord duct 5 on one side thereof. Both of the arm part 10 as the supporting member and the clinching part 10*a* as the auxiliary supporting member have hollow structures as a result of folding metal plates, thereby urging weight saving. In this way, owing to the weight-saving structures of the arm part 10 and the clinching part 10*a*, it is possible to reduce the influence of these elements (10, 10*a*) on the elevating movement of the passenger car 2. Additionally, according to this embodiment, it is established that a length A of the arm part 10 is larger than a length B of the clinching part 10*a*, as shown in FIG. 4. Thus, the establishment in length between the arm part 10 and the clinching part 10*a* serves to suppress an excessive application of a stress exerted to the leading end of the clinching part 10*a* on the arm part 10, in the form of rotating moment. As electrical transmission lines, a tail cord 11 in the form of a flat cable is arranged so as to extend from the passenger car 2 along the arm part 10.

Particularly in this embodiment, as shown in FIG. 4, the leading end of the clinching part 10*a* is arranged in a position outside both of one area S1 interposed between the opposing walls on both sides of the opening 6 and another area S2 defined by extending the former area S1 toward the interior side of the tail-cord duct 5. The above tail cord 11 is suspended from the so-positioned leading end of the clinching part 10*a*.

Again, the tail cord 11 is suspended from the leading position of the clinching part 10*a* of the arm part 10 into the tail-cord duct 5. In other words, the tail cord 11 is suspended in the vicinity of the inner wall 5*a* on one side of the tail-cord duct 5. While, the other end of the tail cord 11 is suspended in the vicinity of another inner wall 5*b* on the other side of the tail-cord duct 5. Noted that the other end of the tail cord 11 is connected to an appropriate element, for example, a not-shown control panel in a machine room (also not shown). In this way, the tail cord 11 is accommodated in the tail-cord duct 5 while being hung in a substantial U-shaped manner.

The arm part 10 is provided, at its portion corresponding to the opening 6, with a through-hole 12 for passage of a governor rope 13 as a side anchoring wire (or safety cable). This governor rope 13 is fixed to the passenger car 2 at a not-shown position and also arranged to extend along the elevating space (elevating direction P) at the opening 6. The governor rope 13 for emergency stop is adapted so as to move at the opening 6 together with the movement of the passenger car 2.

In the above-mentioned structure, when the passenger car 2 moves up and down, one end of the tail cord 11 rises and goes down together with the passenger car 2. Then, corresponding to the elevating position of the passenger car 2, the tail cord 11 varies its lowermost position while maintaining the electrical connection between the passenger car 2 and the control panel (not shown). Further, with the elevating movement of the passenger car 2, the governor rope 13 moves correspondingly. When the moving speed of the governor rope 13 exceeds a predetermined speed, it is carried out to stop moving of the rope 13 forcibly, so that emergency stop means (not shown) on the passenger car 2 is driven to stop it immediately.

In the above-constructed elevator 1A, in a view of FIG. 5, part of the U-shaped lowermost portion of the tail cord 11 is positioned in an area corresponding to the opening 6. In other words, the same part of the tail cord 11 is arranged in a position allowing the tail cord 11 to be visible from the side of the elevating space through the opening 104. However, it should be noted that the most part of the tail cord 11 is positioned in an area that does not coincide with the opening 6. Accordingly, the elevator 1A has a structure that makes it difficult for the tail cord 11 to project from the tail-cord duct 5 due to air current flowing out of the duct 5 through the opening 6. Thus, it is possible to prevent the tail cord 11 from projecting from the interior of the tail-cord duct 5, thereby preventing both damage on the tail cord 11 and occurrence of abnormal noise.

In the first embodiment, repeatedly, the opening 6 is arranged close to the duct's center in comparison with one end of the tail-cord duct 5. Furthermore, the arm's portion entering the duct 5 is deflected toward the end face 5*a*, which means the clinching part 10*a*. This relationship in position between the opening 6 and the arm assembly (i.e. the arm part 10 and the clinching part 10*a*) allows the other side of the tail cord 11 to be suspended at a position (alias, duct's side suspending position) close to the inner wall 5*b* of the other end of the duct 5. Thus, it is possible to accommodate the tail cord 11 in the substantial whole area of the tail-cord duct 5 in a duct-width direction, thereby saving the space of the tail-cord duct 5.

Additionally, according to the first embodiment, since two brushes 8 are arranged on both sides of the opening 6 so as to oppose each other, an opening width of the opening 6 is narrowed by the brushes 8. In operation, these brushes 8 suppress an intrusion of exterior wind into the tail-cord duct 5. Additionally, the brushes 8 operate to prevent the tail cord 11 from projecting out of the tail-cord duct 5.

Again, since the governor rope 13 is supported by the arm part 10, the vibration of the rope 13 is suppressed to allow prevention of occurrence of abnormal noise.

As noted above the arm part 10 is provided, at the opening 8, with the through-hole 12 for passage of the governor rope 13. Therefore, the governor rope 13 itself has a function to prevent the tail cord 11 from projecting from the duct 5.

Furthermore, owing to the arrangement of the governor rope 13 passing through the through-hole 12 in the arm part 10, it is possible to position the governor rope 13 in the opening 18 without increasing its opening width as conventional. Noted that the first embodiment described above is nothing but one application of the invention where the existing "large-width" opening is narrowed by the panel member 4.

As noted above, the rubber members 7 are arranged about the opening 6. Therefore, even if the governor rope 13 oscillates, it is possible to prevent occurrence of abnormal noise owing to the absorbing action of the rubber members 7. Besides the rubber members 7, any member will do so long as its material does not produce noise due to its collision with the rope 13.

2nd. Embodiment

The second embodiment of the present invention will be described with reference to FIG. 6. Note, in this embodiment, elements similar to those of the first embodiment will be indicated with the same reference numerals respectively. Further, their overlapping descriptions will be eliminated in this embodiment basically.

Figure 6:
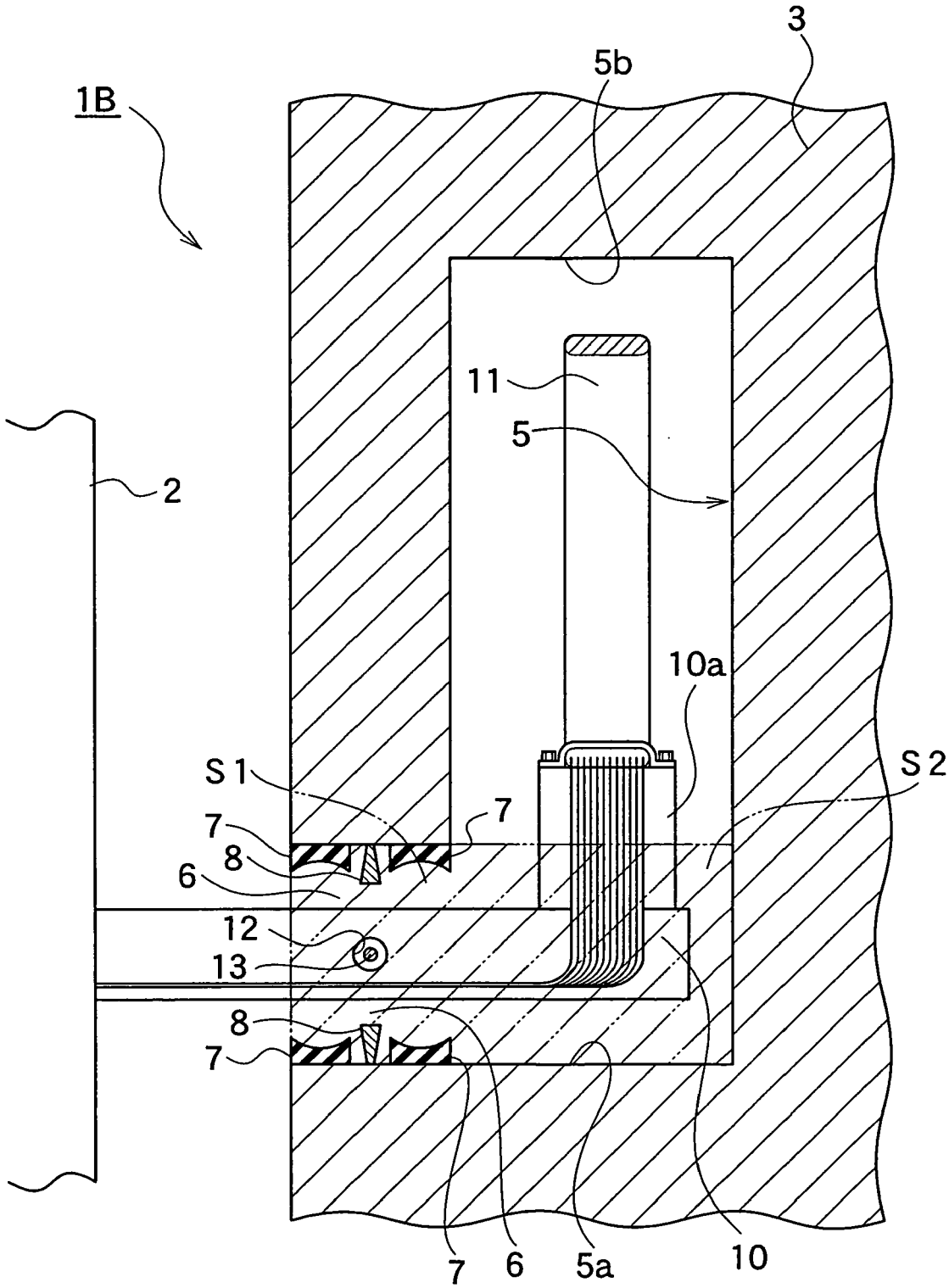
FIG. 6 is a sectional view of the essential part of the elevator in accordance with the second embodiment of the present invention.

FIG. 6 is a sectional view of the essential part of an elevator 1B of the second embodiment. In the elevator 1B of the second embodiment, the opening 6 for the tail-cord duct 5 is arranged at a position close to one side of the tail-cord duct 5. Similarly to the first embodiment, the arm part 2 is fixed to the passenger car 2, while the leading end of the arm part 2 is inserted into the tail-cord duct 5 through the opening 6. In the tail-cord duct 5, the clinching part 10*a* is fixed to the leading end of the arm part 2. Different from the first embodiment, the clinching part 10*a* is arranged so as to project toward the other side of the tail-cord duct 5, namely, the inner wall 5*b*. In the tail-cord duct 5, the tail cord 11 is suspended from the leading end of the clinching part 10*a*. In view of FIG. 6, the leading end of the clinching part 10*a* is apart from the inner wall 5*a* of the tail-cord duct 5 and close to the duct's center in the duct-width direction of the tail-cord duct 5. In this view, the other end of the tail cord 11 is positioned close to the inner wall 5*b* of the tail-cord duct 5 and is suspended from a not-shown upper wall of the duct 5. The other structure of this embodiment is similar to that of the first embodiment and therefore, the related descriptions are eliminated.

In the elevator 1B of the second embodiment, the whole tail cord 11 including the U-shaped lowermost part is accommodated in a duct's area deviated from the other area (S1 and S2) related to the opening 6. Therefore, it is remarkably difficult that the air current flowing out of the duct 5 through the opening 6 causes the tail cord 11 to move in a direction to make it protrude from opening 6. In the second embodiment as well, it is possible to prevent the tail cord 11 from projecting out of the tail-cord duct 5 certainly.

3rd. Embodiment

Figure 7:
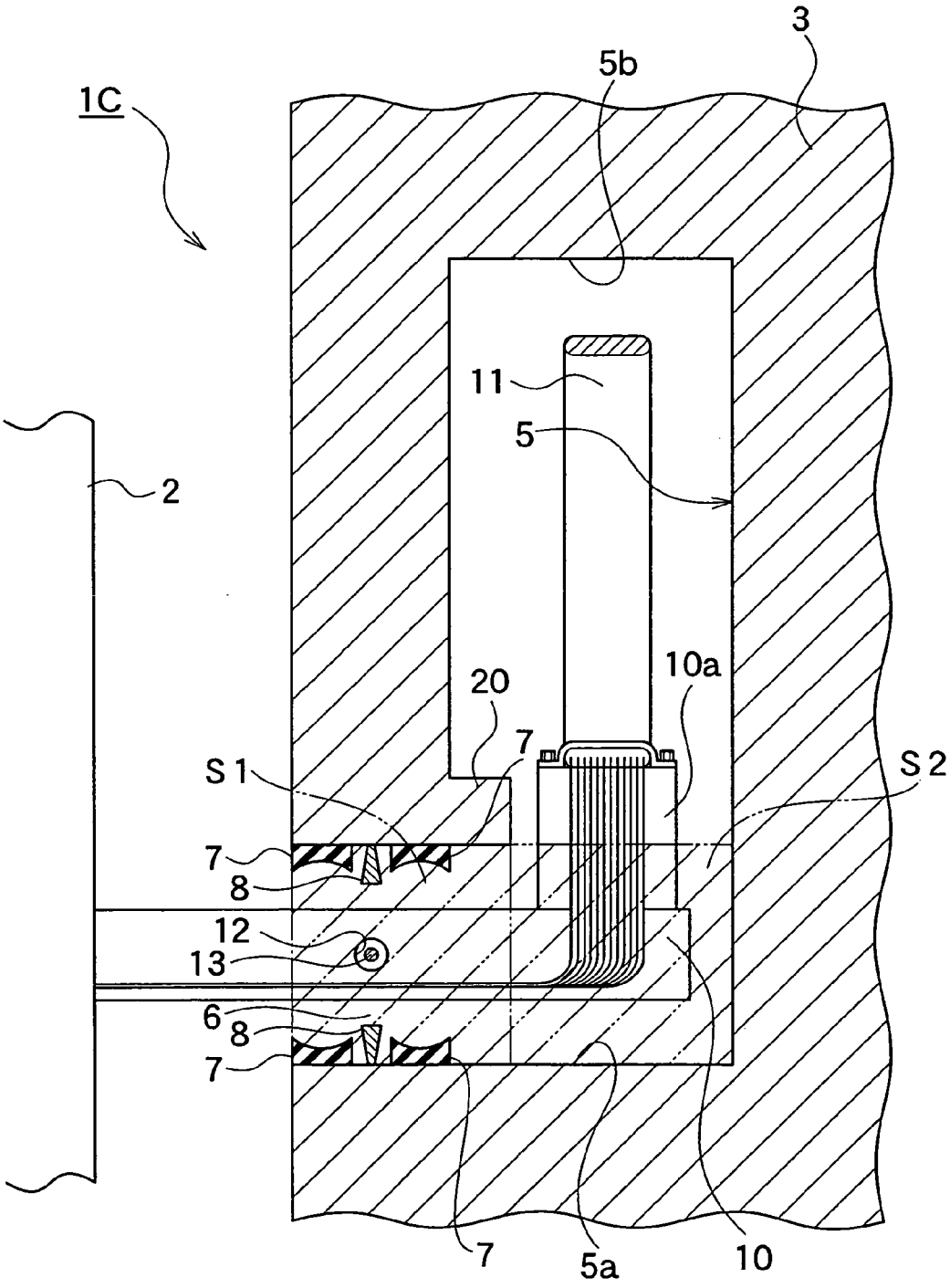
FIG. 7 is a sectional view of the essential part of the elevator in accordance with the third embodiment of the present invention.

FIG. 7 is a sectional view of the essential part of an elevator 1C of the third embodiment of the present invention. Note, in this embodiment, elements similar to those of the second embodiment will be indicated with the same reference numerals respectively. Further, their overlapping descriptions will be eliminated in this embodiment basically.

As shown in FIG. 7, the elevator 1C of the third embodiment is generally similar in constitution to that of the second embodiment except the provision of a windshield wall 20. In a position close to the other end of the opening 6, the windshield wall 20 is formed so as to project toward the inside of the tail-cord duct 6.

In operation, the windshield wall 20 serves to prevent the outside wind from entering the tail-code duct 5 to the utmost. Further, owing to the provision of the windshield wall 20, it becomes more difficult for the tail cord 11 to move in its protruding direction. Accordingly, it is possible to prevent the tail cord 11 from protruding out of the tail-cord duct 5 certainly.

4th. Embodiment

Figure 8:
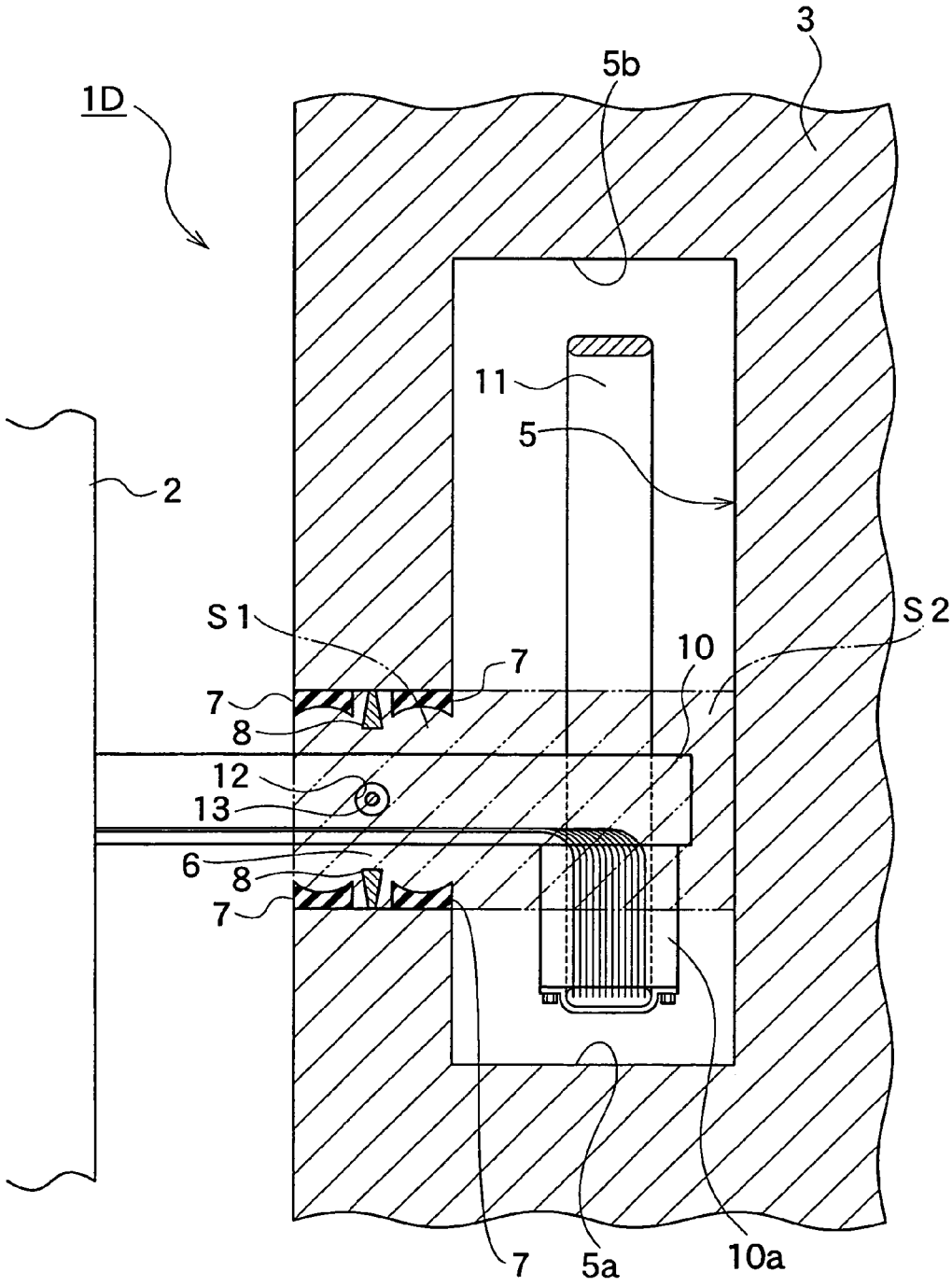
FIG. 8 is a sectional view of the essential part of the elevator in accordance with the fourth embodiment of the present invention.

FIG. 8 is a sectional view of the essential part of an elevator 1D of the fourth embodiment of the present invention. Note, in this embodiment, elements similar to those of the first embodiment will be indicated with the same reference numerals respectively. Further, their overlapping descriptions will be eliminated in this embodiment basically.

As shown in FIG. 8, the elevator 1D of the fourth embodiment is generally similar in constitution to that of the first embodiment except the structure of the opening 6. Different from the first embodiment, no panel member (corresponding to the panel member 4 of the first embodiment) is arranged about the opening 6. Instead, the opening 6 is apart from the inner wall 5*a* of the tail-cord duct 5 and is shifted close to the duct's center in the duct-width direction of the tail-cord duct 5.

In the above-mentioned first embodiment, the opening 6 is formed on one side of the tail-cord duct. Moreover, the panel member 4 is attached to one end of the opening 6, providing an apparent opening as if it were shifted close to the duct's center in the duct-width direction of the tail-cord duct 5. To the contrary, the opening 6 of the fourth embodiment is formed so as to be close to the duct's center in the duct-width direction of the tail-cord duct 5, at the beginning of construction of the elevator 1D. Accordingly, there is no need to provide such a panel member as the first embodiment.

The operation and effect of the fourth embodiment is similar to those of the first embodiment. Additionally, the above-mentioned formation of the opening 6 dispenses with an operation to attach a panel member to one wall defining the opening 6.

5th. Embodiment

Figure 9:
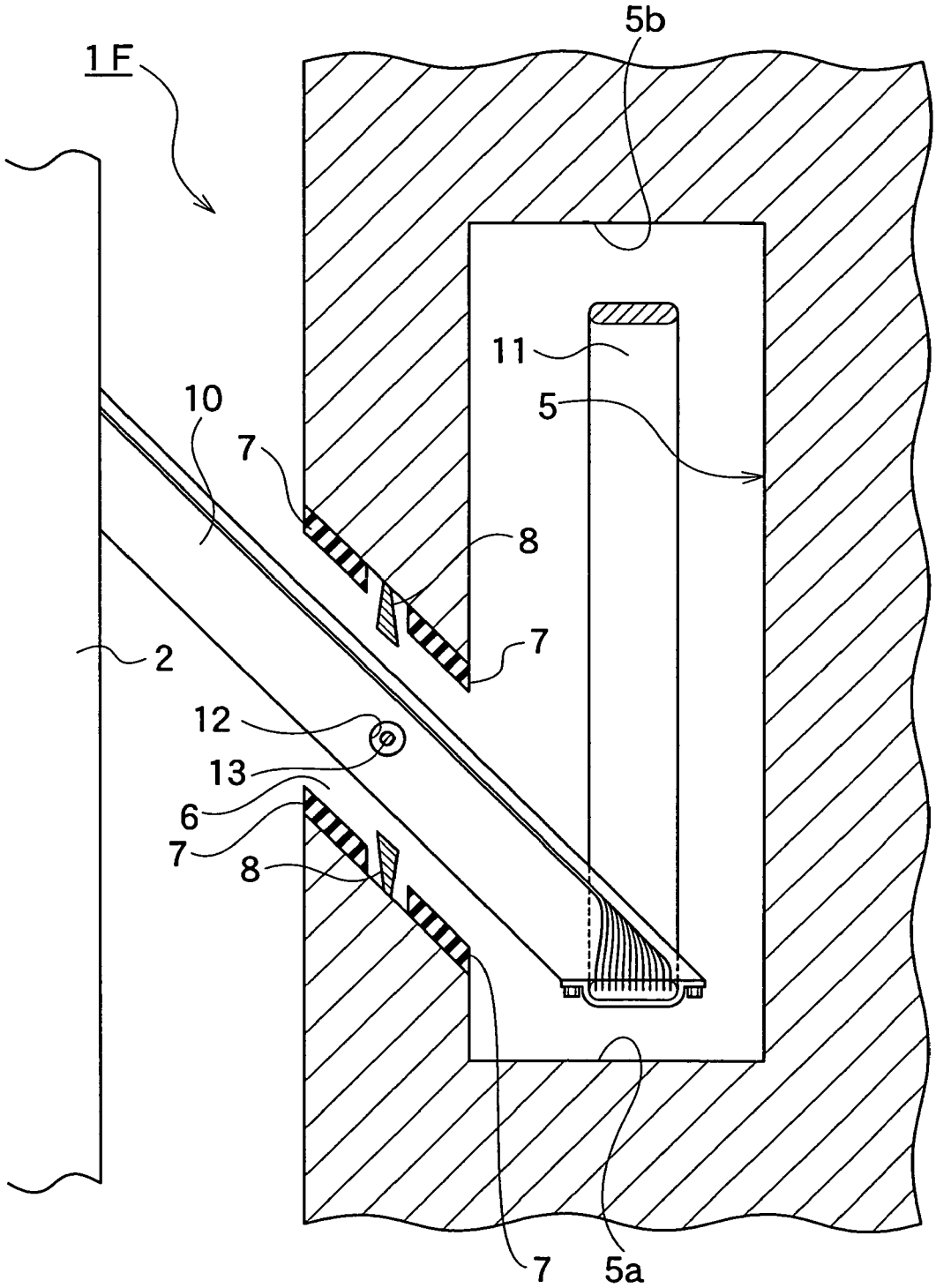
FIG. 9 is a sectional view of the essential part of the elevator in accordance with the fifth embodiment of the present invention.

FIG. 9 is a sectional view of the essential part of an elevator 1F of the fifth embodiment of the present invention. Note, in this embodiment, elements similar to those of the first embodiment will be indicated with the same reference numerals respectively. Further, their overlapping descriptions will be eliminated in this embodiment basically.

The elevator 1F of the fifth embodiment is characterized in that the arm part 10 is formed obliquely to the passenger car 2. Corresponding to the oblique arm part 10, opposing walls on both sides of the opening 6 are formed obliquely. The arm part 10 is provided, at its leading end, with no clinching part (10*a*) as shown in the previous embodiments. The tail cord 11 is carried by the leading end of the arm part 10 directly. The other structure of this embodiment is similar to that of the fourth embodiment and therefore, the related descriptions are eliminated.

According to the fifth embodiment of the invention, since the arm part 10 is formed to extend from the passenger car 2 obliquely, there is no need to provide the arm part 10 with the clinching part 10*a*, whereby the elevator 1F can be simplified in structure. Additionally, since the end of the tail cord 11 is directly supported by the leading end of the arm part 10, the elevator 10F of this embodiment has the advantage of no application of torsional moment on the arm part 10.

As obvious from the foregoing description, according to the present invention, it is possible to prevent the tail cord from being moved in a direction to project it from the tail-cord duct by air current flowing out of the tail-cord duct through the opening. Thus, it is possible to prevent the tail cord from being damaged due to its projection and also possible to prevent an occurrence of abnormal noise.

Finally, it will be understood by those skilled in the art that the foregoing description is merely related to some embodiments of the elevator, and various changes and modifications may be made to the present invention without departing from the spirit and scope thereof. For example, although the above-mentioned embodiments each relate to an elevator intended for an outdoor setting, the present invention is applicable to an indoor elevator which is arranged in such an environment that the tail cord is easy to protrude out of a designated space. Further, opposing parts defining the opening may be shaped to be convex each other or shaped in the form of tips. Additionally, the passenger car doesn't have to be hidden by elevating walls. Again, if only the tail cord is capable of transmission and reception of designated signals, there is no problem to form the tail cord by copper lines or optical fibers.

What is claimed is:

1. An elevator, comprising:

a passenger car having a tail cord extending therefrom, the tail cord being formed of a flat cable;

an elevating space defined so as to encompass the passenger car thereby allowing the passenger car to move up and down therein;

a tail-cord duct adjoining the elevating space, the tail-cord duct having a tail-cord flexure space formed therein to extend along the elevating space in a vertical direction thereof, the tail-cord flexure space accommodating the tail cord therein so that the tail cord extends from its free end on the side of the passenger car up to a duct's side suspending position for suspending the tail cord in a U-shaped manner, the tail-cord duct having an opening formed to extend along and open to the elevating space in a vertical direction;

an arm part fixed to the passenger car so as to project therefrom toward the tail-cord duct, the arm part having its leading end positioned in the tail-cord duct, the arm part having a through-hole in the opening of the tail-cord duct; and a governor rope arranged in the opening of the tail-cord duct so as to extend along the elevating space, the governor rope passing through the through-hole of the arm part, wherein, in plan view of the elevator, the leading end of the arm part is shifted from the opening of the tail-cord duct in a duct-width direction connecting one plan position of the duct's side suspending position with another plan position of the free end of the tail cord, and the free end of the tail cord is carried by the leading end of the arm part.

2. The elevator as claimed in claim 1, wherein the opening is arranged apart from one end of the tail-cord duct on the opposite side of the duct's side suspending position in the duct-width direction and also arranged close to the center of the tail-cord duct in the duct-width direction, and the arm part in the tail-cord duct is bent toward either one of both ends of the tail-cord duct in the duct-width direction.

3. The elevator as claimed in claim 1, wherein the opening is arranged on the side of one end of the tail-cord duct on the opposite side of the duct's side suspending position in the duct-width direction, and a portion of the arm part entering the tail-cord duct is bent toward the duct's side suspending position in the duct-width direction.

4. The elevator as claimed in claim 1, wherein the tail-cord duct is provided, in the vicinity of the opening, with a windshield wall, and the windshield wall is formed so as to project toward the inside of the tail-cord duct while extending vertically along one side of the opening on the side of the duct's side suspending position in the duct-width direction.

5. The elevator as claimed in claim 1, wherein the opening is provided with brushes which extend in a direction to narrow an opening width of the opening.

6. The elevator as claimed in claim 1, wherein a wall part of the tail-cord duct is provided, on its opposing faces defining the opening, with absorbing members.

7. An elevator comprising:

a passenger car;

a transmission line for transmitting signals to move the passenger car up and down, the transmission line being formed of a flat cable;

a supporting member arranged so as to project from the passenger car, the supporting member allowing the transmission line to be suspended therefrom in the vicinity of a leading end of the supporting member, thereby supporting the transmission line, the supporting member having a through-hole; and a governor rope arranged so as to pass through the through-hole, wherein the supporting member has its leading side arranged to extend into a designated space through an opening formed in a structure for supporting the passenger car, and in plan view, a position for suspending the transmission line is deviated from a first area interposed between inner walls on both sides of the opening and a second area obtained by extending the first area along the supporting member, and the governor rope and the through-hole are arranged in the opening formed in the structure for supporting the passenger car.

8. An elevator comprising:

a passenger car;

a transmission line for transmitting signals to move the passenger car up and down, the transmission line being formed of a flat cable;

a supporting member arranged so as to project from the passenger car, the supporting member allowing the transmission line to be suspended therefrom in the vicinity of a leading end of the supporting member, thereby supporting the transmission line, the supporting member having a through-hole; and a governor rope arranged so as to pass through the through-hole, wherein the supporting member has its leading side arranged to extend into a designated space through an opening formed in a structure for supporting the passenger car, and in view from the passenger car, the leading end of the supporting member is positioned on the back side of a wall part forming the structure, and the governor rope and the through-hole are arranged in the opening formed in the structure for supporting the passenger car.

9. The elevator as claimed in claim 8, wherein the wall part defining the designated space is substantial C-shaped or L-shaped in plan view.

10. The elevator as claimed in claim 7 or 8, wherein opposing parts defining the opening are shaped to be plane.

11. The elevator as claimed in claim 7 or 8, wherein the supporting member is provided, at its leading end, with an auxiliary supporting member which extends in a different direction from the extending direction of the supporting member, for supporting the transmission line, and the transmission line is suspended from the auxiliary supporting member.

12. The elevator as claimed in claim 11, wherein the supporting member is longer than the auxiliary supporting member.

13. The elevator as claimed in claim 11, wherein the transmission line suspended from the supporting member or the auxiliary supporting member is arranged outside both an elevating space for the passenger car and an extension area of the elevating space in the vertical direction.

14. The elevator as claimed in claim 7 or 8, wherein the supporting member projects in a direction substantially perpendicular to an exterior surface of the passenger car.

15. The elevator as claimed in claim 7 or 8, wherein the passenger car is arranged outside the structure thereby moving up and down outside the structure.

16. The elevator as claimed in claim 7 or 8, wherein only the transmission line is hidden by the structure.

17. The elevator as claimed in claim 7 or 8, wherein the transmission line is in the form of a tape.

18. The elevator as claimed in claim 7 or 8, wherein the transmission line is adapted so as to transmit and receive designated signals to and from a control unit for controlling the elevating movement of the passenger car.

19. The elevator as claimed in claim 7 or 8, wherein the opening and the designated space are together formed along the elevating direction of the passenger car.

20. The elevator as claimed in claim 7 or 8, wherein the transmission line is suspended from one side of the supporting member and subsequently raised toward the upper part of the designated space.

21. The elevator as claimed in claim 7 or 8, wherein the supporting member or the auxiliary supporting member is a hollow member.

* * * * *